US007896987B2

(12) United States Patent
Di Salvo

(10) Patent No.: US 7,896,987 B2
(45) Date of Patent: Mar. 1, 2011

(54) HIGH ENERGY, LOW TEMPERATURE GELLED BI-PROPELLANT FORMULATION

(75) Inventor: Roberto Di Salvo, Madison, AL (US)

(73) Assignee: CFD Research Corporation, Huntsville, AL (US)

( * ) Notice: Subject to any disclaimer, the term of this patent is extended or adjusted under 35 U.S.C. 154(b) by 815 days.

(21) Appl. No.: 11/292,442

(22) Filed: Dec. 2, 2005

(65) Prior Publication Data

US 2009/0320973 A1 Dec. 31, 2009

(51) Int. Cl.
*C06B 47/00* (2006.01)
*D03D 23/00* (2006.01)

(52) U.S. Cl. ..... 149/1; 149/108.8

(58) Field of Classification Search ..... 149/1, 108.8; 60/211

See application file for complete search history.

(56) References Cited

U.S. PATENT DOCUMENTS

| | | | | |
|---|---|---|---|---|
| 3,380,250 | A * | 4/1968 | Whatley | 60/204 |
| 4,499,723 | A * | 2/1985 | Frankel et al. | 60/211 |
| 5,438,824 | A * | 8/1995 | Asaoka et al. | 60/251 |
| 6,210,504 | B1 * | 4/2001 | Thompson | 149/1 |

* cited by examiner

*Primary Examiner* — Aileen Felton

(74) *Attorney, Agent, or Firm* — Tomas Friend

(57) ABSTRACT

The present invention is a bi-propellant system comprising a gelled liquid propane (GLP) fuel and a gelled MON-30 (70% $N_2O_4$+30% NO) oxidizer. The bi-propellant system is particularly well-suited for outer planet missions greater than 3 AU from the sun and also functions in earth and near earth environments. Additives such as powders of boron, carbon, lithium, and/or aluminum can be added to the fuel component to improve performance or enhance hypergolicity. The gelling agent can be silicon dioxide, clay, carbon, or organic or inorganic polymers. The bi-propellant system may be, but need not be, hypergolic.

13 Claims, 4 Drawing Sheets

HIGH ENERGY, LOW TEMPERATURE GELLED BI-PROPELLANT FORMULATION

STATEMENT REGARDING FEDERALLY SPONSORED RESEARCH OR DEVELOPMENT

The U.S. Government may have certain rights in this invention pursuant to SBIR Contract No. NNM05AA56C awarded by NASA.

CROSS-REFERENCE TO RELATED APPLICATIONS

Not Applicable

INCORPORATED-BY-REFERENCE OF MATERIAL ON A CD

Not Applicable

BACKGROUND OF THE INVENTION

1. Field of the Invention

The present invention relates to rocket propellants. More specifically, the present invention is a low-storage temperature bipropellant combination that provides for reduced power budgets devoted to propellant warming and offers significant improvements in safety operations combined with high performance. This enables, for example, missions to the outer planets on lower power budgets than is currently possible. This propellant technology also has applications in upper stage orbital maneuvering requiring high-performance, low temperature bi-propellants.

2. Description of Related Art

As a spacecraft moves farther from the sun, less radiant heat is absorbed and the temperature within insulated fuel tanks decreases (Koelle, H. H., Editor, *Handbook of Astronautical Engineering*, McGraw-Hill Book Company, Inc., 1961). Thermal Control Systems (TCSs) are required to prevent fuel and oxidizer from freezing when they are not in use and to heat them to operating temperatures between 16 and 26° C. before use (Avila, A., Cagle, C., Ledeboer, W., and Stultz, J., "Thermal design of the Galileo bus and Retro Propulsion Module," AIAA-1989-1749, Thermophysics Conference, 24th, Buffalo, N.Y., Jun. 12-14, 1989; Barter, N., Editor, *TRW Space Data*, TRW Space & Electronics Group, 1999). For distances from the sun greater than 3 AU, the portion of the power budget consumed by heaters to prevent propellant freezing increases significantly.

With planned missions demanding more science for less money, the amount of power budget necessary for propellant heating must be minimized to avoid limiting mission objectives. There is, therefore, a need in the art for rocket propellants having very low freezing and operating temperatures. Fuels and oxidizers having low freezing points such as Liquid Hydrogen (LH) and liquid Oxygen (LOX) are not suitable for use on-planetary probes because they require cryogenic storage vessels capable of containing them within several AU of the sun. Propane is a gaseous hydrocarbon that readily liquefies by compression and cooling, melts at −189.9° C. and boils at −42.2° C. These physical properties make it a potential low-temperature propellant. MON (mixed oxides of nitrogen) is a solution of nitric oxide (NO) in dinitrogen tetroxide/nitrogen dioxide (NTO). MON propellants are used oxidizers on some military and commercial satellites. The freezing points of existing MONs are not low enough to be ideal candidates for use on deep space missions.

Gelling of rocket propellants has been accepted in the last decade as a method of improving performance and reducing environmental impact. For example, U.S. Pat. No. 6,013,143 (Thompson) discloses hypergolic fuel bipropellants containing inhibited red fuming nitric acid (IRFNA), nitrogen tetroxide (NTO), hydrogen peroxide, and hydroxyl ammonium nitrate oxidizers and monomethyl hydrazine (MMH), dimethylaminoethylazide, pyrollidinylethylazide, bis (ethyl azide) methylamine fuels gelled with silicon dioxide, clay, carbon, or polymers. U.S. Pat. No. 6,165,293 (Allan) discloses a thixotropic IRFNA gel oxidizer for use in hypergolic fuel bipropellants. U.S. Pat. No. 6,652,682 (Fawls) discloses gelled bipropellants doped with nano-sized boron particles.

The above patents, all of which are incorporated by reference in their entirety, disclose gelled propellants having improved safety and reduced environmental hazards compared to non-gelled propellants. The gelling of propellants to lower freezing points, operating temperatures, vapor pressures, or tankage weights is not disclosed.

BRIEF SUMMARY OF THE INVENTION

The present invention is a bi-propellant system comprising gelled liquid propane (GLP) fuel and gelled MON-30 (70% $N2O_4$+30% NO) oxidizer. The bi-propellant system is particularly well-suited for outer planet missions but also functions in near earth environments. Additives such as powders of boron, carbon, lithium, and/or aluminum can be added to the fuel component to improve performance or enhance hypergolicity. The gelling agent can be silicon dioxide, clay, carbon, or organic or inorganic polymers. The bi-propellant system may be, but need not be, hypergolic.

DETAILED DESCRIPTION OF THE INVENTION

The present invention is a bipropellant formulation comprising a gelled liquid propane (GLP) fuel component and a highly energetic, gelled MON-30 (70% $N_2O_4$+30% NO) oxidizer component. The bipropellant system provides a vacuum specific impulse ($I_{sp,1000\text{-}vac}$) as high as 360 seconds. The energy density of the propulsion system can be further improved by adding an energetic additive, such as a submicron powder of boron, carbon, or aluminum to the fuel component. Increasing the density of the propellant through the addition of energetic powders also allows for higher thrust levels in volume-limited propulsion systems. Although applicable in many operational environments, the formulation is particularly useful for outer planetary missions because of the very low freezing points and operational temperatures of the fuel and oxidizer.

Liquid MON propellants of up to 25% NO (75% $N_2O_4$+25% NO) are sometimes used as oxidizers on military and commercial satellites. The non-gelled form of the invented oxidizer is MON-30 (70% $N_2O_4$+30% NO), which has a freezing point of −16.1° C., or 7.1° C. lower than MON-25. Gelling of MON-30, in addition to the well-known safety benefits, reduces the possibility of combustion instability, seen in some MON systems, where the nitric oxide (NO) can flash at the injector face. Most importantly, gelling MON-30 reduces the freezing point relative to the liquid and lowers operational temperatures as well.

Propane, $CH_3CH_2CH_3$, is a gaseous hydrocarbon that readily liquefies by compression and cooling and melts at −189.9° C. and boils at −42.2° C. Gelling the propellant provides the advantage of higher volumetric efficiency.

Figure 1:
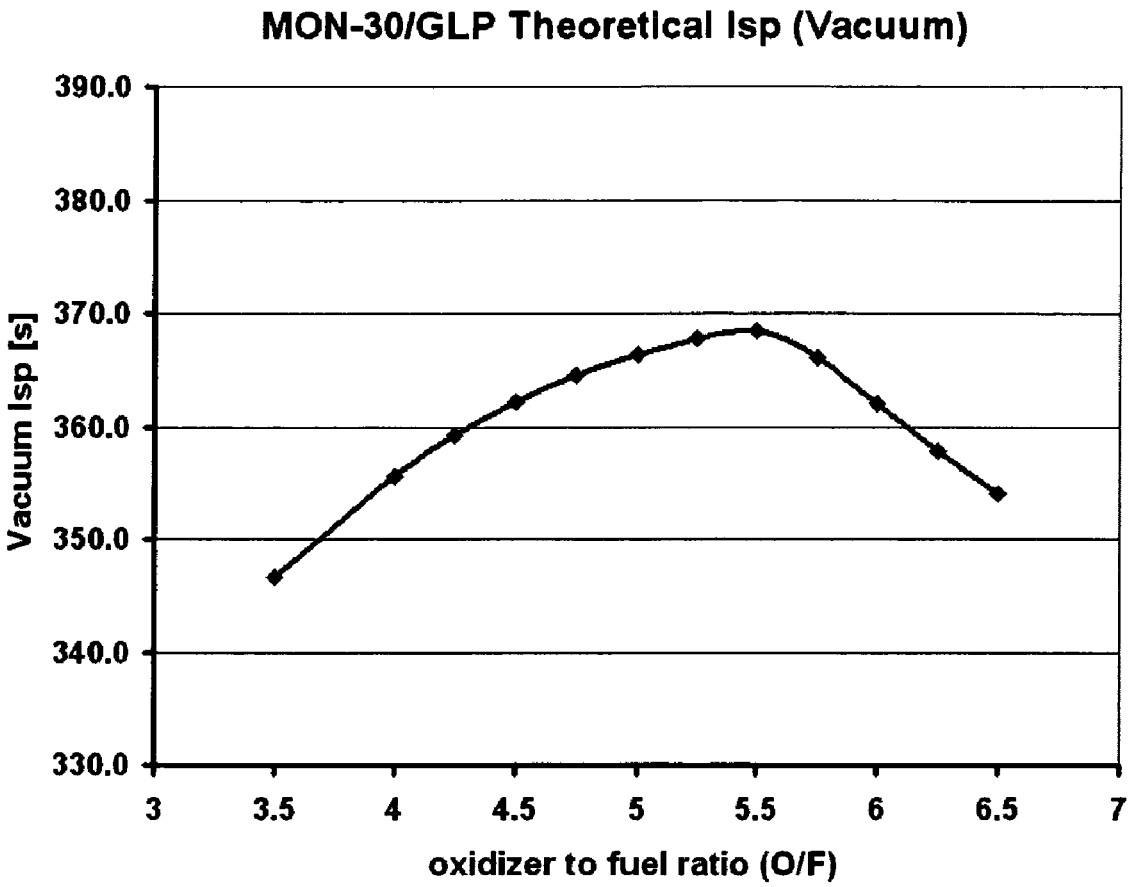
FIG. 1 Theoretical Vacuum Specific Impulse of gelled MON-30/gelled propane

To verify the ballistic properties of the gelled MON-30/GLP bi-propellant system, the vacuum specific impulse as a function of O/F ratio was computed and the results are plotted in FIG. 1. With a chamber pressure of 1,000 psia, an O/F ratio of 5.5, an expansion ratio of 300 can provide a maximum vacuum Isp of 368.4 seconds. This performance makes this propellant system fully competitive with current bi-propellant combinations such as NTO/MMH.

LP and MON-30 Gelling Apparatus and General Methods

MON-30 and GLP gelling/mixing can performed using a variety of devices, methods, and conditions. The following method and apparatus is provided as an example and it is understood by those skilled in the art that other methods of mixing may also be used. MON-30 and GLP are gelled using one-liter churn-mixers, each comprising a cylindrical vessel that is sealed by a piston-like closure-lid. A rod, attached externally to a pneumatic actuator, goes through the center of the closure-lid and attaches to a perforated chum-plate. The churn-plate has thirty-six, 6 mm diameter holes and is pneumatically cycled up and down, through the entire mixer volume, forcing the entire mass of liquid and gelling agents through the perforations with each half-cycle.

The mixing temperatures are around −20° C. for MON-30 and around −50° C. for LP. Gelling agents may include silicon dioxide, clay, carbon, organic or inorganic polymers, or combinations thereof. Generally, the % by weight of gelling agent used is the minimum required to achieve the desired physical properties. The amount of gallant used is preferably 1% to 12% by weight and most preferably 2% to 5% by weight. In one preferred embodiment, the gelling agent for MON-30 and LP is fumed silica. A small amount of polymeric agent, such as hydroxypropyl cellulose, may also be added to improve long-term storage characteristics. Surfactants may be used to improve the "wetting" of a gellant. Hypergolicity of the fuel may be increased including small amounts of Lithium metal, hydrogen gas, or MMH.

Synthesis and Gelling of MON-30

The oxidizer for the low-temperature propellant combination is MON-30. MONs are solutions of Nitric Oxide (NO) in Dinitrogen Tetroxide/Nitrogen Dioxide. The reaction that takes place as NO is added to $NO_2$ is shown below. The reaction is exothermic and releases 6000 kcal/kg.

$$NO+NO_2 \rightarrow N_2O_3$$

Figure 2:
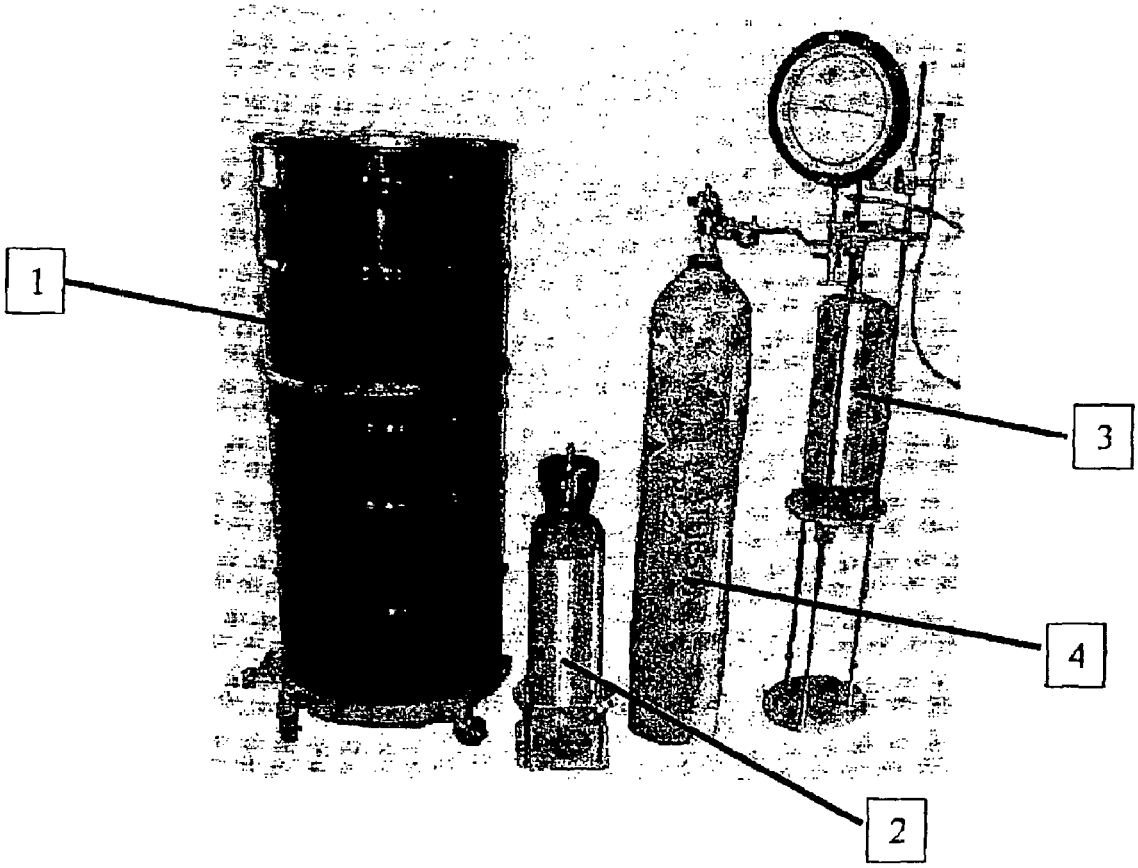
FIG. 2 Apparatus For Producing Mixed Oxides Of Nitrogen (MON)
Figure 3:
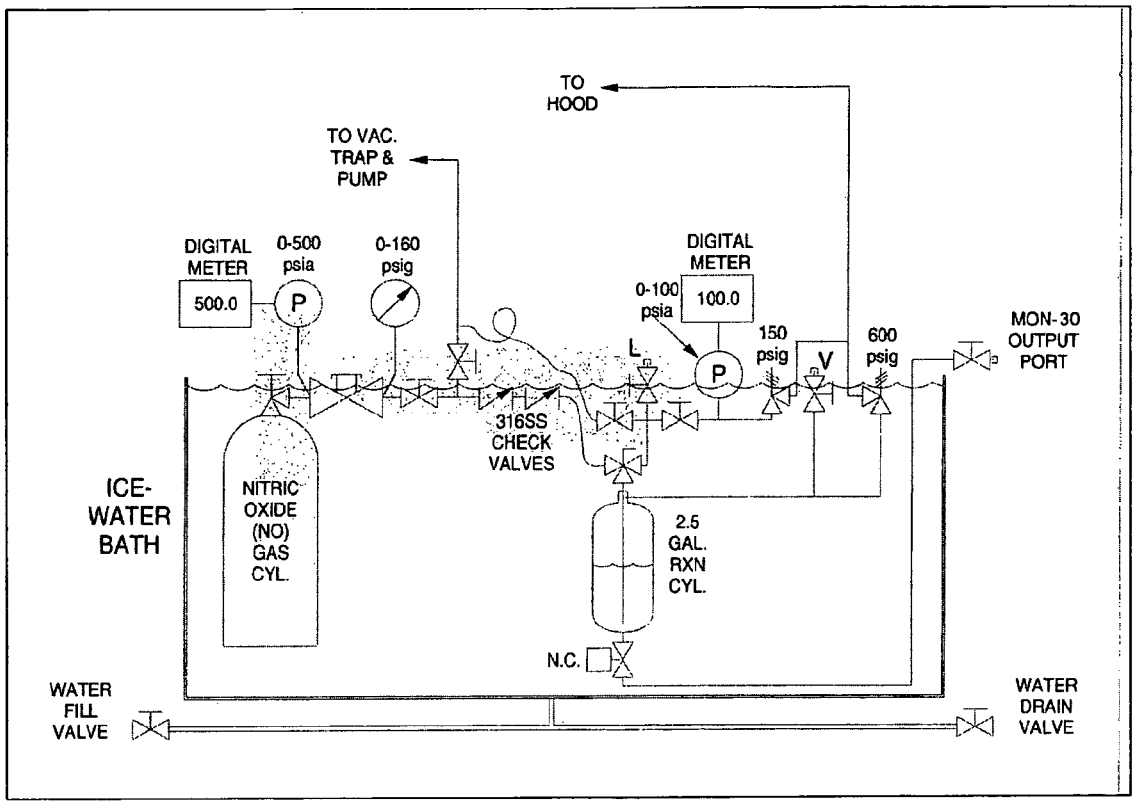
FIG. 3 Integrated System Diagram With The Various Components Identified

One type of apparatus that may be used to synthesize MON-30 is shown in FIG. 2. Shown are the ice water bath 1, $NO_2$ transfer tank 2, reaction cylinder 3, and nitrous oxide tank 4. FIG. 3 shows a diagram of the integrated system with the various components identified. MON-30 was synthesized by apply vacuum to all system hardware, feeding 500 g of liquid $NO_2$ into the reaction cylinder, and lowering the reaction cylinder apparatus and NO tank into the ice water bath to maintain the temperature of the reactants at 0° C. Once the pressure in the reaction cylinder and the NO bottle reach equilibrium, 214 g of NO was metered into the reaction cylinder.

The MON-30 was gelled at around −25° C. with 3% fumed silica by weight using a plate churn mixer. The mixture was churned for approximately 2 minutes. The gelled MON-30 has a freezing point of −81° C.

Gelling Liquid Propane

Figure 4:
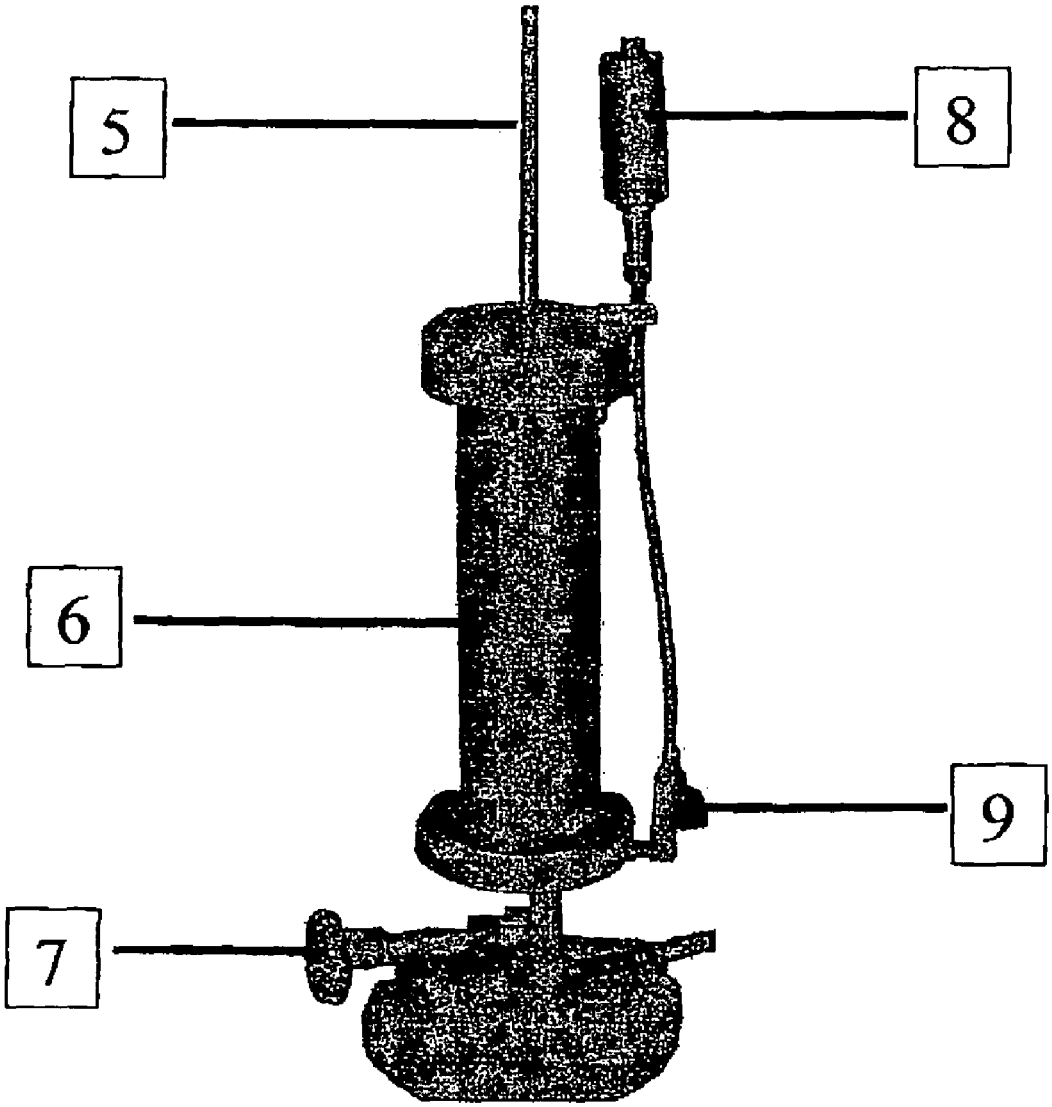
FIG. 4 Liquid propane gel mixer

Propane was gelled using a plate chum mixer shown in FIG. 4 placed inside an insulated polyethylene drum filled with a water-ethylene glycol mixture cooled to −55° C. Elements of the plate chum mixer shown in FIG. 4 are the mixer actuator rod 5, mixing/storage vessel 6, cryogenic valve 7, absolute pressure transducer 8, and pressure transducer disconnect valve 9. 20 grams of Cabot M-5® fumed silica were introduced into the mixing vessel. After addition of the silica, the vessel was attached to a vacuum pump, evacuated, and cooled in dry ice for 10 minutes. 500 grams of liquid propane was introduced into the mixing vessel. For the churning phase, the system was submerged in a 70/30-ethylene glycol/water bath and cooled to −55° C. Once the mixing vessel pressure reached approximately 8 psia, the mixture was churned for approximately 2 minutes. The gelled propane has a freezing point of −189.9° C.

What is claimed is:

1. A bi-propellant formulation consisting of a thixotropic gelled propane fuel and an oxidizer, wherein said gelled propane fuel consists of:

liquid propane and a gellant selected from the group consisting of silicon dioxide, clay, carbon, fumed silica, an organic polymer, an inorganic polymer, and mixtures thereof.

2. The bi-propellant formulation of claim 1, wherein the oxidizer consists of:

liquid MON-30;

a gellant selected from the group consisting of silicon dioxide, clay, carbon, fumed silica, an organic polymer, an inorganic polymer, and mixtures thereof; and an additive selected from the group consisting of monomethyl hydrazine, hydroxypropyl cellulose, carbon, aluminum, boron, and mixtures thereof.

3. The bi-propellant formulation of claim 1, wherein the gellant is present in an amount of 3% to 5% by weight.

4. The bi-propellant formulation of claim 3, wherein the gelled propane fuel consists of liquid propane and fumed silica in a weight ratio of 25:1.

5. The bi-propellant formulation of claim 4, wherein the oxidizer is a gelled MON-30.

6. The bi-propellant formulation of claim 1, wherein the oxidizer consists of:

liquid MON-30 and a gellant selected from the group consisting of silicon dioxide, clay, carbon, fumed silica, an organic polymer, an inorganic polymer, and mixtures thereof.

7. The bi-propellant formulation of claim 3, wherein the gelled propane fuel consists of liquid propane and fumed silica in a weight ratio of 25:1.

8. A bi-propellant formulation consisting of a thixotropic gelled propane fuel and an oxidizer, wherein said gelled propane fuel consists of:

liquid propane;

a gellant selected from the group consisting of silicon dioxide, clay, carbon, fumed silica, an organic polymer, an inorganic polymer, and mixtures thereof; and an additive selected from the group consisting of monomethyl hydrazine, hydroxypropyl cellulose, carbon, aluminum, boron, and mixtures thereof.

9. The bi-propellant formulation of claim 8, wherein the oxidizer consists of:

liquid MON-30;

a gellant selected from the group consisting of silicon dioxide, clay, carbon, fumed silica, an organic polymer, an inorganic polymer, and mixtures thereof; and an additive selected from the group consisting of monomethyl hydrazine, hydroxypropyl cellulose, carbon, aluminum, boron, and mixtures thereof.

10. The bi-propellant formulation of claim 8, wherein the gellant is present in an amount of 3% to 5% by weight.

11. The bi-propellant formulation of claim 10, wherein the gelled propane fuel consists of liquid propane and fumed silica in a weight ratio of 25:1 and, an additive selected from the group consisting of monomethyl hydrazine, hydroxypropyl cellulose, and mixtures thereof.

12. The bi-propellant formulation of claim 11, wherein the oxidizer is a gelled MON-30.

13. The bi-propellant formulation of claim 8, wherein the oxidizer consists of:

liquid MON-30 and a gellant selected from the group consisting of silicon dioxide, clay, carbon, fumed silica, an organic polymer, an inorganic polymer, and mixtures thereof.

* * * * *